US006667609B2

(12) United States Patent
Verbeck et al.

(10) Patent No.: US 6,667,609 B2
(45) Date of Patent: Dec. 23, 2003

(54) CURRENT GENERATING DEVICE WITH REDUCED SWITCHING TIME FROM AN ENERGY SAVING MODE

(75) Inventors: Michael Verbeck, München (DE); Thomas Piorek, München (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/262,178

(22) Filed: Sep. 30, 2002

(65) Prior Publication Data

US 2003/0076081 A1 Apr. 24, 2003

Related U.S. Application Data

(63) Continuation of application No. PCT/DE01/01237, filed on Mar. 27, 2001.

(30) Foreign Application Priority Data

Mar. 28, 2000 (DE) ..... 100 15 276

(51) Int. Cl.[7] ..... G05F 3/16
(52) U.S. Cl. ..... 323/315; 323/317
(58) Field of Search ..... 323/315, 317

(56) References Cited

U.S. PATENT DOCUMENTS

| | | | | | |
|---|---|---|---|---|---|
| 4,918,370 | A | * | 4/1990 | Botti | 323/317 |
| 5,204,612 | A | * | 4/1993 | Lingstaedt | 323/317 |
| 5,264,784 | A | * | 11/1993 | Ortiz | 323/315 |
| 5,559,425 | A | | 9/1996 | Allman | 323/315 |
| 5,598,095 | A | * | 1/1997 | Schnaitter | 323/315 |
| 5,642,037 | A | | 6/1997 | Malherbe | 323/316 |
| 5,751,182 | A | | 5/1998 | Thiel, IV | 327/539 |
| 5,754,477 | A | | 5/1998 | Forbes | 365/185.33 |
| 5,940,322 | A | | 8/1999 | Atsumi | 365/185.18 |
| 6,002,294 | A | | 12/1999 | Kushibe | 327/543 |
| 6,404,252 | B1 | * | 6/2002 | Wilsch | 323/315 |
| 6,515,461 | B2 | * | 2/2003 | Akiyama et al. | 323/316 |

* cited by examiner

*Primary Examiner*—Jeffrey Sterrett
(74) *Attorney, Agent, or Firm*—Laurence A. Greenberg; Werner H. Stemer; Ralph E. Locher

(57) ABSTRACT

A current generating device is characterized in that it is configured for, in response to a predetermined event, temporarily impresses a current, which is modified in comparison to the usual current, onto a device connected to the current generating device. In addition, a voltage generating device is configured for, in response to the predetermined event, temporarily applying a voltage, which is modified in comparison to the usual voltage, to the device connected to the voltage generating device.

9 Claims, 1 Drawing Sheet

CURRENT GENERATING DEVICE WITH REDUCED SWITCHING TIME FROM AN ENERGY SAVING MODE

CROSS-REFERENCE TO RELATED APPLICATION

This application is a continuation of copending International Application No. PCT/DE01/01237, filed Mar. 27, 2001, which designated the United States and was not published in English.

BACKGROUND OF THE INVENTION

FIELD OF THE INVENTION

The present invention relates to apparatuses having a current generating device by which a predetermined current can be forced to flow into a device which is connected to it, and, respectively, a voltage generating device, by which a predetermined voltage can be applied to a device which is connected to it.

Apparatuses such as these have been known in innumerable embodiments for many years and require no further explanation.

They are used, inter alia, but, as is known, in no way exclusively, in integrated circuits, where they supply current or voltage either to the entire integrated circuit or to specific parts of the integrated circuit.

Current generating devices or voltage generating devices which are provided in integrated circuits do not need to be active all the time. This may be for two reasons: either because the respective currents or voltages produced by the current generating devices or voltage generating devices are required only in response to specific events (for example for programming a flash memory), or because the devices which are supplied with power from the current generating devices or from the voltage generating devices need or should not always be in operation.

Circuits or circuit parts which need or should not always be in operation are frequently switched to an energy saving operating mode, such as a so-called sleep operating mode or a so-called power-down operating mode, at times in which they are not required. In these operating modes, the relevant circuits or circuit parts are switched to a state in which they consume less power, or no power whatsoever. This allows the power consumption, and heat that is produced, to be reduced.

There are various options for switching a circuit or a circuit part to an energy saving operating mode. The current generating device or voltage generating device which supplies power to the relevant circuit or the relevant circuit part is preferably deactivated for this purpose; this allows the power consumption and the amount of heat produced to be reduced to the maximum extent.

Circuits or circuit parts which are switched to an energy saving operating mode can be reset to the normal operating mode again when required, in which as the title itself makes evident, they are supplied with power in the normal way, and operate in the normal way.

Experience has shown that it takes a certain amount of time to switch a circuit or a circuit part from an energy saving operating mode to the normal operating mode. Therefore, it is necessary to wait for a greater or lesser time period after initiation of the operating mode switching process, before the relevant circuit or the relevant circuit part can be used as normal.

Since it is frequently not evident in advance whether, and possibly when, a circuit or a circuit part must be switched back to the normal operating mode, the switching process is generally initiated only at the time at which the relevant circuit or the relevant circuit part is required. However, since it is still necessary to wait for a certain time after this before the process of switching to the normal operating mode has been completed (until the relevant circuit or the relevant circuit part is once again operating, or can operate, correctly), switching to the normal operating mode is associated with a pause of greater or lesser duration, during which the integrated circuit which contains the relevant circuit or the relevant circuit part cannot operate, or in any case cannot operate at maximum power.

This is obviously a disadvantage.

SUMMARY OF THE INVENTION

It is accordingly an object of the invention to provide a current generating device and a voltage generating device which overcomes the above-mentioned disadvantages of the prior art devices and methods of this general type, in which the switching of a circuit or of a circuit part from an energy saving operating mode to the normal operating mode can be sped up.

With the foregoing and other objects in view there is provided, in accordance with the invention, a current generating device. The current generating device has a circuit for generating a predetermined current that can be forced to flow into a device connected to the circuit. The predetermined current is different than a specific current which would otherwise flow, the predetermined current flowing temporarily into the device in response to a predetermined event.

The current generating device according to the invention is distinguished in that it is configured to force a current, which is different to that which would otherwise flow, to flow temporarily into the device which is connected to the current generating device, in response to the predetermined event, and the voltage generating device according to the invention is distinguished in that it is configured to temporarily apply a voltage, which is different to that which would otherwise occur, to the device which is connected to the voltage generating device, in response to a predetermined event.

Current generating devices and voltage generating devices such as these allow the circuit or the circuit part which is supplied with power in this way to be briefly supplied with a current or a voltage which speeds up the process of reaching the normal operating mode, after initiation of the switching process from an energy saving operating mode to the normal operating mode.

The fact that a circuit or a circuit part is supplied during the change in operating mode with a current or with a voltage which is higher or lower than the current or the voltage which the current generating device or the voltage generating device would force to flow or would apply if the fact that a change in operating mode is being carried out has not been signaled to it has been found to be advantageous from two points of view. First, in consequence, this makes it possible to overcome the defect associated with conventional current and voltage generating devices that, once these devices have been switched on, they do not immediately and directly supply the currents and voltages which they supply during steady-state normal operation and, second, the current generating devices and voltage generating devices can in consequence even supply currents and voltages during the change in operating mode which are intentionally higher or lower than the currents and voltages which are generated during steady-state normal operation of the current and voltage generating devices.

This makes it possible for the relevant circuit or the relevant circuit part to more quickly reach the state that it must assume in order to operate normally. In particular, this makes it possible for the capacitances in the circuit that is to be switched or in the circuit part that is to be switched, including any parasitic capacitances such as line capacitances (capacitances which are formed by the lines in the circuit or in the circuit part) and gate capacitances (capacitances at gate connections of field-effect transistors) to be charged, discharged or have their charges reversed more quickly than is required for correct operation of the circuit or of the circuit part. Furthermore, suitable currents and voltages at the source and/or drain connections of field-effect transistors make it possible to form a conductive channel more quickly in the relevant field-effect transistors.

The use of current generating devices or voltage generating devices configured as described, and suitable actuation of them, make it possible to switch a circuit or a circuit part from an energy saving operating mode to the normal operating mode in the shortest possible time. It is even possible to use the circuit to be switched or the circuit part to be switched as normal immediately (even in the next clock cycle).

In accordance with an added feature of the invention, the predetermined event indicates that the device connected to the circuit has switched from an energy saving operating mode to a normal operating mode. The device has at least one read amplifier for reading data stored in a memory device. The predetermined current which the circuit forces to flow into the device is temporarily greater or less than the specific current which the circuit would force to flow at a relevant time if the predetermined event had not occurred. The predetermined current which the circuit forces to flow into the device in response to the predetermined event is temporarily greater or less than the specific current which the circuit forces to flow into the device in a steady state.

In accordance with another feature of the invention, the circuit contains a current generator generating a given current. The circuit contains a transistor connected to the current generator such that the given current generated by the current generator flows through the transistor. The circuit additionally contains a further transistor through which the specific current that is not generated by the current generator flows. The transistor and the further transistor are configured and connected such that currents flowing the transistor and the further transistor are in a specific ratio to one another, and the specific current flowing through the further transistor is forced to flow into the device connected to the circuit. Preferably, the transistor and the further transistor are connected to form a current mirror.

In accordance with an additional feature of the invention, the circuit is constructed such that the transistor, through which the given current generated by the current generator flows, also has a further current which is not generated by the current generator and flows through the transistor when the predetermined event occurs. A switching device is provided, and the further current is produced by switching on the switching device. The switching device is connected in series with the transistor and through the transistor the given current generated by the current generator and the further current flow. An operation of the switching device results in an opening and closing of a given circuit containing the transistor and the switching device. The switching device is a transistor having a gate connection receiving a signal signaling an occurrence of the predetermined event, and in response to the signal, the predetermined current that is different to that which would otherwise flow is forced to flow into the device connected to the circuit.

In accordance with a further feature of the invention, a high-pass filter is connected to the switching device, and the signal controlling the switching device is applied to the switching device through the high-pass filter. Alternatively, a low-pass filter is connected to the switching device, and the signal controlling the switching device is applied to the switching device through the low-pass filter.

In accordance with a concomitant feature of the invention, the further transistor is one of a plurality of further transistors, the further transistors are connected to the transistor to form the current mirror.

Other features which are considered as characteristic for the invention are set forth in the appended claims.

Although the invention is illustrated and described herein as embodied in a current generating device and a voltage generating device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
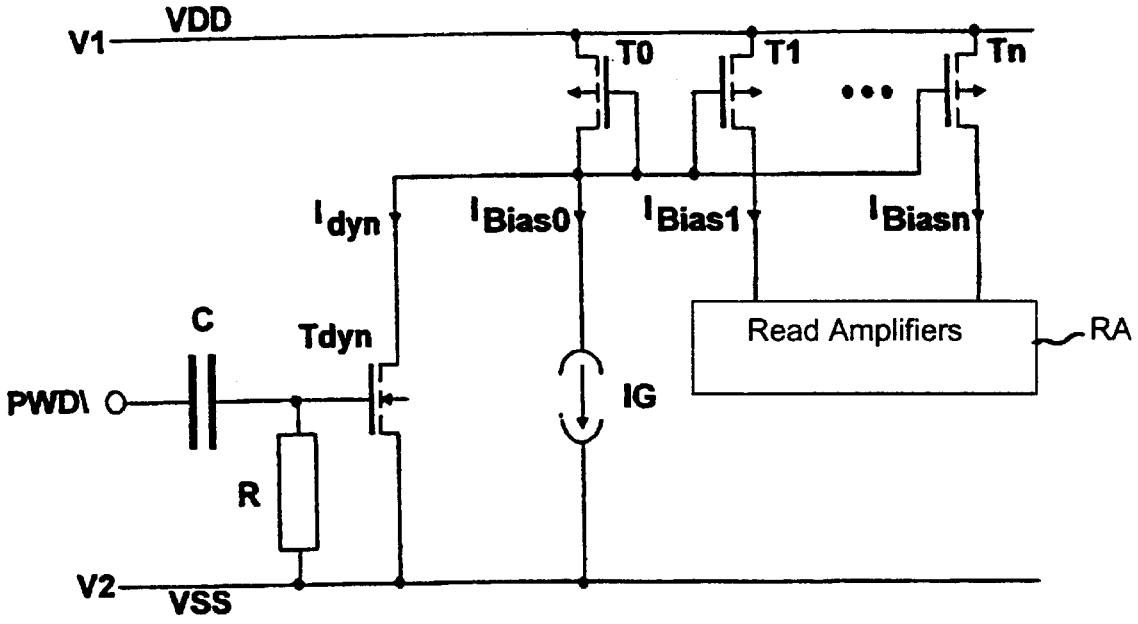
FIG. 1 is a circuit diagram of an exemplary embodiment of a current generating device according to the invention.

Referring now to the figures of the drawing in detail and first, particularly, to FIG. 1 thereof, there is shown a current generating device and a voltage generating device which are components of an integrated circuit. In the example under consideration, the integrated circuit is a microcontroller. The described current generating device and voltage generating device are used in the example under consideration to supply power to read amplifiers RA for reading a memory (an embedded memory) that is provided in the microcontroller.

However, it should be mentioned at this point that this does not represent any restriction. The described current generating device and the described voltage generating device may also be used in any other desired integrated circuits and outside integrated circuits, and may be used for supplying any desired devices within or outside integrated circuits.

The described current generating device is distinguished in that it is configured to force (provide) a current, which is different to that which would otherwise flow, to flow temporarily into the device (i.e. read amplifiers RA) which is connected to the current generating device, in response to a predetermined event(s).

The described voltage generating device is distinguished in that it is configured to temporarily apply a voltage, which is different to that which would otherwise occur, to the device which is connected to the voltage generating device, in response to the predetermined event.

These special features are used in the example under consideration in order to change the device which is to be supplied with power by the current generating device or the voltage generating device as quickly as possible from an energy saving operating mode, such as the so-called sleep operating mode or the so-called power-down operating mode, to a normal operating mode. The special features of the described current generating device and of the described voltage supply device may, however, also advantageously be used for other purposes, for example in order to change the device to be supplied with power to a state in which it is ready to operate more quickly after the system has been switched on.

The described current generating device is illustrated in FIG. 1. The current generating device has a bias current generator IG, PMOS transistors T0 to Tn, an NMOS transistor Tdyn, a capacitor C and a resistor R.

The bias current generator IG produces a current $I_{Bias0}$, which is converted to bias currents $I_{Bias1}$ to $I_{Biasn}$, in the manner that will be described in more detail in the following text, by the transistors T0 to Tn, which are connected to form a current mirror. The bias currents $I_{Bias1}$ to $I_{Biasn}$ are the currents which are forced to flow into the read amplifiers RA of the microcontroller under consideration, and via which the read amplifiers RA are supplied with the power required to operate.

The bias current generator IG is connected in series with the transistor T0. The current $I_{Bias0}$ that is generated by the bias current generator therefore flows through the transistor T0. A current flow through the transistor T0 also results in currents flowing through the transistors T1 to Tn, which are connected to the transistor T0 to form a current mirror, to be precise the currents $I_{Bias1}$ to $I_{Biasn}$, which have already been mentioned above. A magnitude of the currents $I_{Bias1}$ to $I_{Biasn}$, depends on the W/L ratios between the transistor T0 and the transistors T1 to Tn.

For the sake of completeness, it should be noted that the currents $I_{Bias1}$ to $I_{Biasn}$, do not originate from the bias current generator IG. The currents originate from supply lines V1 and V2, to which a positive potential VDD (V1) and a neutral or negative potential VSS (V2) are applied from some other power source, which is not shown in the FIG. 1.

During normal operation of the configuration, the currents $I_{Bias1}$ to $I_{Biasn}$ have a constant magnitude that is not zero. When the devices (the read amplifiers RA) that are to be supplied with power are switched to the energy saving operating mode, which has already been mentioned above, the currents $I_{Bias0}$ to $I_{Biasn}$ are equal to zero.

Figure 2:
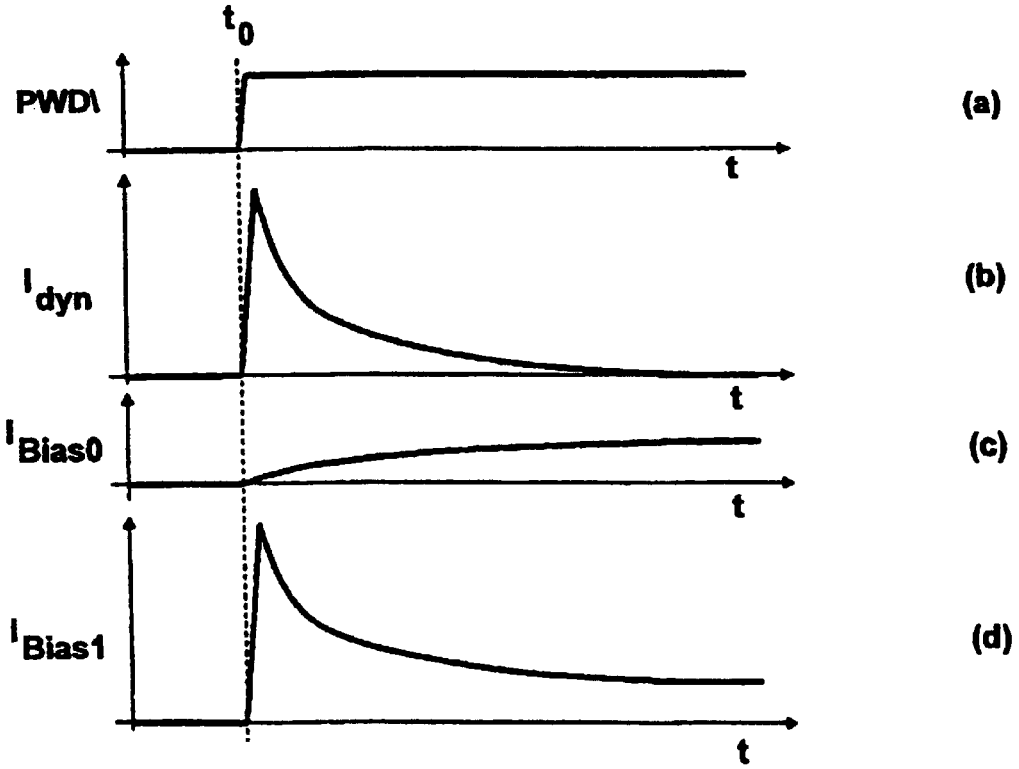
FIG. 2 is a timing diagram illustrating relationships that occur in the current generating device shown in FIG. 1.

When the read amplifiers RA are switched from the energy saving operating mode to the normal operating mode, the bias current generator IG (which was deactivated during the energy saving operating mode) is activated. However, during this process, the current $I_{Bias0}$ that is generated by the bias current generator does not rise suddenly, but only very gradually to the magnitude that it needs to have for correct operation of the read amplifiers RA. This is shown by diagram (c) in FIG. 2, which will be described in more detail in the following text. Without the special features (which will be described in more detail in the following text) of the current generating device under consideration, the currents $I_{Bias1}$ to $I_{Biasn}$ would have a similar profile to that which would result if it were to take a relatively long time for the read amplifiers RA to reach a state in which they are ready to operate.

The current generating device under consideration avoids this by the special features that will be described in more detail in the following text. The special features contain an additional circuit part, which makes it possible to influence the current flowing through the transistor T0, and hence also the currents $I_{Bias1}$ to $I_{Biasn}$ which are forced to flow through the transistors T1 to Tn into the devices which are connected to them.

In the example under consideration, the additional circuit part ensures that a current $I_{dyn}$ that is not generated by the bias current generator IG also flows through the transistor T0 (through which the current $I_{Bias0}$ which is generated by the bias current generator IG flows) when a predetermined event occurs.

The additional current $I_{dyn}$ is caused to flow by switching on a switching device Tdyn which is connected in series with the transistor T0, through which the current which is generated by the bias current generator IG and the additional current flow, and whose operation results in the opening and closing of a circuit which contains the transistor T0 and the switching device Tdyn.

In the example under consideration, the switching device Tdyn is formed by a transistor Tdyn that is provided in parallel with the bias current generator IG. The transistor is the transistor Tdyn, which has already been mentioned in the introduction.

When and for as long as the transistor Tdyn is actuated such that it is switched on, a current $I_{dyn}$ (which is taken from the supply lines V1 and V2) flows through it. Since the transistor Tdyn is connected in series with the transistor T0, the current $I_{dyn}$ also flows through the transistor T0. A current which corresponds to a sum of the currents $I_{Bias0}+I_{dyn}$ therefore flows through the transistor T0.

The transistor Tdyn is controlled by a signal which signals the event in response to which a current which is different to that which would otherwise flow is forced to flow into the read amplifiers RA which are connected to the current generating device.

In the example under consideration, the signal is a power-down signal PWD\, which indicates the operating mode of the device that is connected to the current generating device, and is supplied to the gate connection of the transistor Tdyn via a high-pass filter. In the example under consideration, the high-pass filter is formed by the already mentioned capacitor C, and the resistor R, which has likewise already been mentioned.

In the example under consideration, the level of the power-down signal PWD\ is 0 when the read amplifiers RA are in the energy saving operating mode, and its level is 1 when the read amplifiers RA are in the normal operating mode.

The transistor Tdyn and the high-pass filter RC connected upstream of it are disposed and configured such that the current $I_{dyn}$ flows "only" briefly after initiation of the process of switching the read amplifiers RA from the energy saving operating mode to the normal operating mode, and such that the current $I_{dyn}$ is zero at all other times.

When and for as long as the level of the power-down signal PWD\ is not changed, the high-pass filter R, C blocks the signal, so that the transistor Tdyn is switched off irrespective of the level of the power-down signal PWD\.

This situation changes when the read amplifiers RA, which are in the energy saving operating mode, are switched to the normal operating mode. In the example under consideration, this may be the situation at a time t0.

In this case, at the time t0, the power-down signal PWD\ changes suddenly from the level 0 to the level 1. This is shown in diagram (a) in FIG. 2.

The high-pass filter R, C which is connected upstream of the gate connection of the transistor Tdyn allows the power-down signal PWD\ to be applied briefly to the gate connection of the transistor Tdyn. Therefore, the transistor Tdyn is temporarily switched on, as a result of which the current $I_{dyn}$ that is not zero flows through the transistor Tdyn. The time profile of the current $I_{dyn}$ is shown in diagram (b) in FIG. 2. As shown there, the current $I_{dyn}$ initially rises steeply from t0 to a relatively high value, and then falls gradually back to the value zero.

Independently of this, after the time t0, the current, to be more precise $I_{Bias0}$, also flows through the bias current generator IG, which is activated once again after this time. The time profile of the current $I_{Bias0}$ is shown in diagram (c) in FIG. 2. According to this, the current $I_{Bias0}$ rises gradually from the value zero after t0 to the current that is required for correct operation of the read amplifiers RA.

A current which corresponds to the sum of the currents $I_{Bias0}+I_{dyn}$ now flows through the transistor T0. The current flow also results in currents with corresponding time profiles flowing in the transistors T1 to Tn. The profile of the current flowing through the transistor T1 (and which is forced to flow into the associated read amplifiers RA) is illustrated in diagram (d) in FIG. 2. As shown there, the current $I_{Bias1}$ initially rises steeply after t0 to a relatively high value, and then gradually falls back to the current that is required to operate the read amplifiers RA correctly when they are in the steady state.

Since—in contrast to the situation with conventional current generating devices—once the process of switching a circuit or a circuit part from the energy saving operating mode to the normal operating mode has been initiated, the current which initially flows is not less than the current which is required for correct operation of the read amplifiers RA when they are in the steady state, and the current which flows is greater than the current which is required for correct operation of the read amplifiers RA when they are in the steady state, the read amplifiers RA can be switched to a state in which they are ready to operate considerably more quickly than was previously the case. In particular, the higher current makes it possible to more quickly charge, discharge or reverse the charge of capacitances in the read amplifiers RA, including parasitic capacitances such as line capacitances and gate capacitances, as is required for correct operation of the read amplifiers RA. Furthermore, this also allows channels to be set up more quickly in the field-effect transistors.

The corresponding situation also applies, of course, when the device that is to be supplied by the current generating device does not contain one or more read amplifiers RA, but is any other desired device.

Depending on the characteristics of the device RA which is connected to the current generating device, it may also be advantageous for the current generating device to be configured to force a current which is less than that which would otherwise flow to flow into the relevant device, temporarily, in response to specific events.

The event in response to which the current generating device forces a current which is different to that which would otherwise flow to flow into the device RA which is connected to it need not be the switching of the relevant device from an energy saving operating mode to the normal operating mode; it may also be any other desired event.

The special features of the current generating device described above may also be used analogously for voltage generating devices. A voltage generating device such as this is distinguished in that it is configured to temporarily apply a voltage, which is different to that which would otherwise occur, to the device which is connected to the voltage generating device, in response to a predetermined event, in which case the voltage which the voltage generating device applies to the device which is connected to it in response to the predetermined events may be "only" somewhat greater or less than the voltage which the voltage generating device would apply at the relevant time if the predetermined event had not occurred, or may even be greater or less than the voltage which the voltage generating device applies to the device in the steady state.

Those skilled in the art are well aware of how a voltage which is temporarily different to that which would otherwise occur can be generated, and this does not require any further explanation.

If the device to which the voltage which is generated by the voltage generating device is applied is a current generating device which generates a current whose magnitude depends on the voltage which is generated by the voltage generating device, then a voltage generating device such as this (and a conventional current generating device) can achieve the same effect as that with the novel current generating device described above.

Any other desired devices may, of course, also be connected to the voltage generating device and, of course, the events in response to which the voltage generating device generates a voltage which is different to that which would otherwise occur may be any desired events.

Current generating devices and voltage generating devices which are configured as described or in a similar manner can advantageously be used for widely differing applications.

Inter alia, but by no means exclusively, they allow a circuit or a circuit part to be switched from an energy saving operating mode to the normal operating mode as quickly as possible.

We claim:

1. A current generating device, comprising:

a current mirror for providing an output current and for forcing said output current to flow into a device connected to said current mirror;

a bias current generator for injecting a first current into said current mirror;

a switching device for injecting a second current into said current mirror in response to receiving an input signal indicating a predetermined event;

said output current being dependent upon a sum of said first current and said second current.

2. The current generating device according to claim 1, wherein, in response to the predetermined event, said switching device temporarily injects the second current into said current mirror.

3. The current generating device according to claim 1, wherein said switching device is configured such that the second current decays from a relatively high value to a relatively smaller steady state value.

4. The current generating device according to claim 1, wherein the predetermined event is a transition from an energy saving operating mode to a normal operating mode.

5. The current generating device according to claim 1, wherein said switching device is a transistor.

6. The current generating device according to claim 1, wherein:

said bias current generator and said switching device are connected in parallel thereby forming a parallel circuit; and said current mirror includes a transistor connected in series with said parallel circuit.

7. The current generating device according to claim 1, further comprising a high-pass filter for filtering said input signal before said input signal is applied to said switching device.

8. The current generating device according to claim 1, in combination with the device connected to said current mirror, wherein the device connected to said current mirror includes at least one a read amplifier for reading data stored in a memory device.

9. The current generating device according to claim 1, in combination with the device connected to said current mirror, wherein said bias current generator is constructed such that the first current has a steady state value equal to that required for correct operation of the device connected to said current mirror.

* * * * *